US010570618B2

(12) United States Patent
Liescheidt

(10) Patent No.: US 10,570,618 B2
(45) Date of Patent: Feb. 25, 2020

(54) BUILDING CHORD AND BUILDING TRUSS

(71) Applicant: Timothy Michael Liescheidt, Charlotte, NC (US)

(72) Inventor: Timothy Michael Liescheidt, Charlotte, NC (US)

( * ) Notice: Subject to any disclaimer, the term of this patent is extended or adjusted under 35 U.S.C. 154(b) by 0 days.

(21) Appl. No.: 16/032,856

(22) Filed: Jul. 11, 2018

(65) Prior Publication Data

US 2019/0277030 A1 Sep. 12, 2019

Related U.S. Application Data

(60) Provisional application No. 62/639,079, filed on Mar. 6, 2018.

(51) Int. Cl.

| | |
|---|---|
| ***E04B 1/18*** | (2006.01) |
| ***E04C 3/07*** | (2006.01) |
| ***E04C 3/40*** | (2006.01) |
| *E04C 3/04* | (2006.01) |

(52) U.S. Cl.

CPC ..... *E04C 3/07* (2013.01); *E04C 3/40* (2013.01); *E04C 2003/046* (2013.01); *E04C 2003/0491* (2013.01)

(58) Field of Classification Search

CPC ..... E04C 3/07; E04C 3/40; E04C 2003/046; E04C 2003/0491

USPC ..... 52/634, 731.7, 506.07, 733.1, 846

See application file for complete search history.

(56) References Cited

U.S. PATENT DOCUMENTS

| | | | | | |
|---|---|---|---|---|---|
| 2,167,835 | A * | 8/1939 | Greulich | E04C 3/292 | 52/376 |
| 2,169,253 | A * | 8/1939 | Kotrbaty | E04B 2/845 | 52/693 |
| 2,457,250 | A * | 12/1948 | Macomber | E04C 3/09 | 105/422 |
| 2,662,272 | A * | 12/1953 | Macomber | B21D 47/04 | 29/417 |
| 5,499,480 | A * | 3/1996 | Bass | E04C 3/07 | 52/653.1 |
| 5,771,653 | A * | 6/1998 | Dolati | E04C 3/07 | 52/545 |
| 5,970,678 | A * | 10/1999 | Pellock | E04C 3/11 | 52/843 |
| 6,047,511 | A * | 4/2000 | Lehane | E04B 9/068 | 29/521 |
| 6,170,217 | B1 * | 1/2001 | Meyer | E04B 1/24 | 29/897.31 |
| 6,519,908 | B1 * | 2/2003 | Masterson | E04C 3/08 | 52/289 |
| 6,658,809 | B2 * | 12/2003 | Collins | E04C 3/07 | 52/639 |
| 8,056,294 | B2 * | 11/2011 | LaLonde | E04B 9/06 | 52/506.08 |

(Continued)

*Primary Examiner* — Basil S Katcheves

(74) *Attorney, Agent, or Firm* — Clements Bernard Walker

(57) ABSTRACT

The present invention provides methods and systems for a building truss chord including a first face having a bottom longitudinal corner and a top longitudinal corner. A second face having a bottom longitudinal corner and a top longitudinal corner, a portion of the first face and the second face are spaced apart and form a cavity between the inner surfaces of the first face and the second face. A lower connection member is disposed between the bottom longitudinal corner of the first face and the bottom longitudinal corner of the second face.

13 Claims, 9 Drawing Sheets

(56) References Cited

U.S. PATENT DOCUMENTS

| | | | | |
|---|---|---|---|---|
| 8,141,318 | B2 * | 3/2012 | Dunbar | E04C 3/07 52/636 |
| 8,359,801 | B2 * | 1/2013 | Lehane, Jr. | B21D 5/08 248/344 |
| 8,359,812 | B2 * | 1/2013 | Raheel | B21D 47/01 29/897.35 |
| 9,975,577 | B2 * | 5/2018 | Strickland | B62D 21/02 |
| 2002/0020138 | A1 * | 2/2002 | Walker | E04C 3/07 52/715 |
| 2008/0155934 | A1 * | 7/2008 | Wendt | E04B 9/068 52/846 |

* cited by examiner

BUILDING CHORD AND BUILDING TRUSS

CROSS REFERENCE TO RELATED PATENT APPLICATION

The present patent application/patent claims the benefit of priority of U.S. Provisional Patent Application No. 62/639,079, filed on Mar. 6, 2018, and entitled "BUILDING TRUSS," the contents of which are incorporated in full by reference herein.

FIELD OF THE INVENTION

The present invention relates generally to a chord for use in building trusses and more generally relates to a chord formed by cold rolling sheet metal with a first face and a second face having a first flange extending outwardly from the first face and a second flange extending outwardly from the second face, wherein the first face and the second face are spaced apart forming a cavity therein.

BACKGROUND OF THE INVENTION

A truss is well-known in the building industry and are used for residential, commercial, and industrial building. The truss spans a length that will ultimately support a structure, such as a roof, adjacent floor, parking deck, etc. It is important for a truss to be sturdy and able to bear all loads applied to the truss. It is an object of the present invention to provide an improved chord for constructing a building truss.

BRIEF SUMMARY OF THE INVENTION

According to an embodiment of the present invention, a building truss chord include a first face having a bottom longitudinal corner and a top longitudinal corner. A second face has a bottom longitudinal corner and a top longitudinal corner, a portion of the first face and second face are spaced apart and form a cavity between the inner surfaces of the first face and the second face. A lower connection member is disposed between the bottom longitudinal corner of the first face and the bottom longitudinal corner of the second face.

According to another embodiment of the present invention, the chord includes a first flange that extends laterally outwardly from the first face.

According to yet another embodiment of the present invention, the chord includes a second flange that extends laterally outwardly from the second face.

According to yet another embodiment of the present invention, the chord includes a lip extending downwardly from the first flange.

According to yet another embodiment of the present invention, the chord includes a lip extending downwardly from the second flange.

According to yet another embodiment of the present invention, the chord includes a first neck portion on the first face that is angled towards a longitudinal axis of the chord and a second neck portion on the second face that is angled towards the longitudinal axis of the chord.

According to yet another embodiment of the present invention, the chord includes an internal surface on the first face and an internal surface on the second face that are engaged to each other and form an end to the cavity.

According to yet another embodiment of the present invention, the chord includes a first face having a bottom longitudinal corner and a top longitudinal corner, a second face having a bottom longitudinal corner and a top longitudinal corner. Two portions of the first face and the second face are spaced apart and form a first cavity and a second cavity between the inner surfaces of the first face and the second face. A lower connection member disposed between the bottom longitudinal corner of the first face and the bottom longitudinal corner of the second face.

According to yet another embodiment of the present invention, a building truss includes an upper chord and a lower chord. The upper chord and lower chord includes a first face having a bottom longitudinal corner and a top longitudinal corner. A second face having a bottom longitudinal corner and a top longitudinal corner, a portion of the first face and second face are spaced apart and form a cavity between the inner surfaces of the first face and the second face. A lower connection member is disposed between the bottom longitudinal corner of the first face and the bottom longitudinal corner of the second face. At least one diagonal web is positioned between and engaged to the upper chord and the lower chord, and at least one vertical web is positioned between and engaged to the upper chord and the lower chord.

According to yet another embodiment of the present invention, the building truss includes a plurality of diagonal webs positioned between and engaged to the upper chord and the lower chord.

According to yet another embodiment of the present invention, the building truss includes a plurality of vertical webs positioned between and engaged to the upper chord and the lower chord.

According to yet another embodiment of the present invention, the building truss is composed of metal.

According to yet another embodiment of the present invention, the building truss includes a diagonal web and a vertical web that has a base portion that extends outwardly to two opposed sides and a first side extends upwardly from one side of the base portion and a second side extends upwardly from the second side of the base portion.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
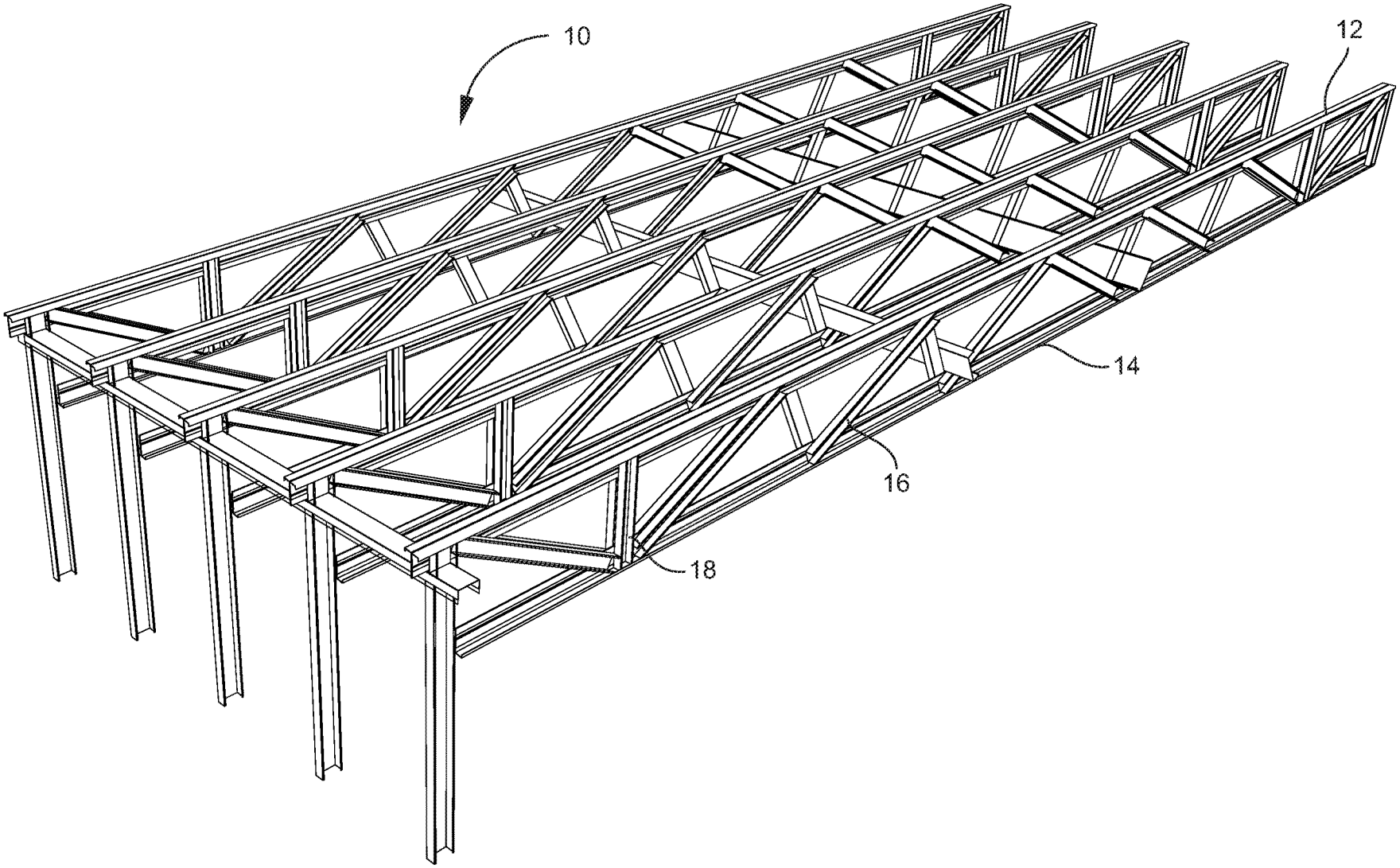
FIG. 1 is a perspective view of the truss of the present invention.

Referring now specifically to the drawings, a truss according to the present invention is illustrated in FIG. 1 and is shown generally at reference numeral 10. The truss 10 is composed of an upper chord 12 and a lower chord 14 that are formed by cold rolling sheet metal cut from stock. A diagonal web 16 engages the upper chord 12 to the lower chord 14. As shown in FIG. 1, a plurality of diagonal webs 16 engage the upper chord 12 to the lower chord 14. A vertical web 18 is disposed adjacent each diagonal web 16. The upper chord 12, the lower chord 14, and the webs 16, 18 are preferably all metal, such as steel, steel alloy, aluminum, and/or aluminum alloy.

Figure 2:
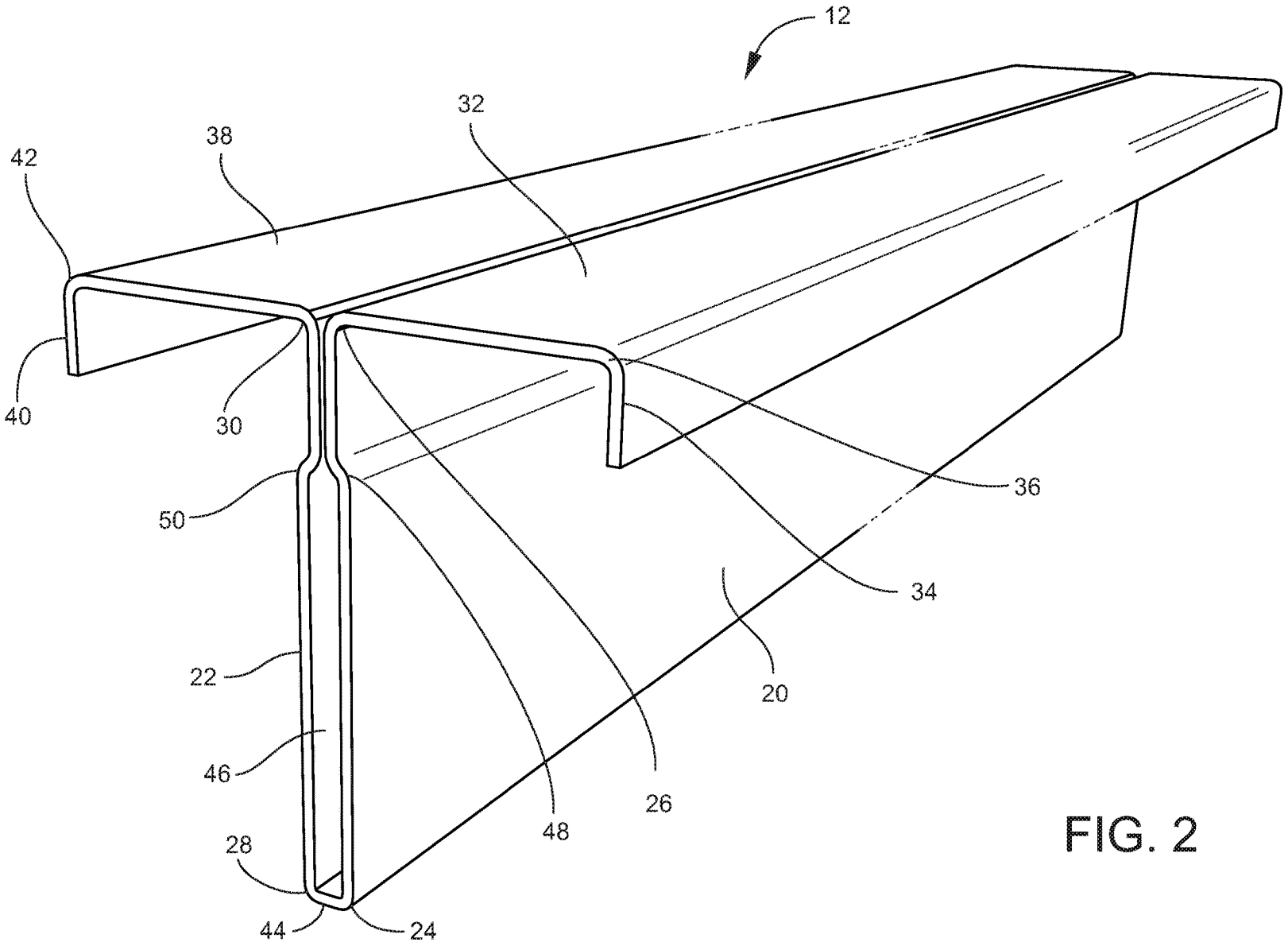
FIG. 2 is a perspective view of the upper chord of the present invention.
Figure 4:
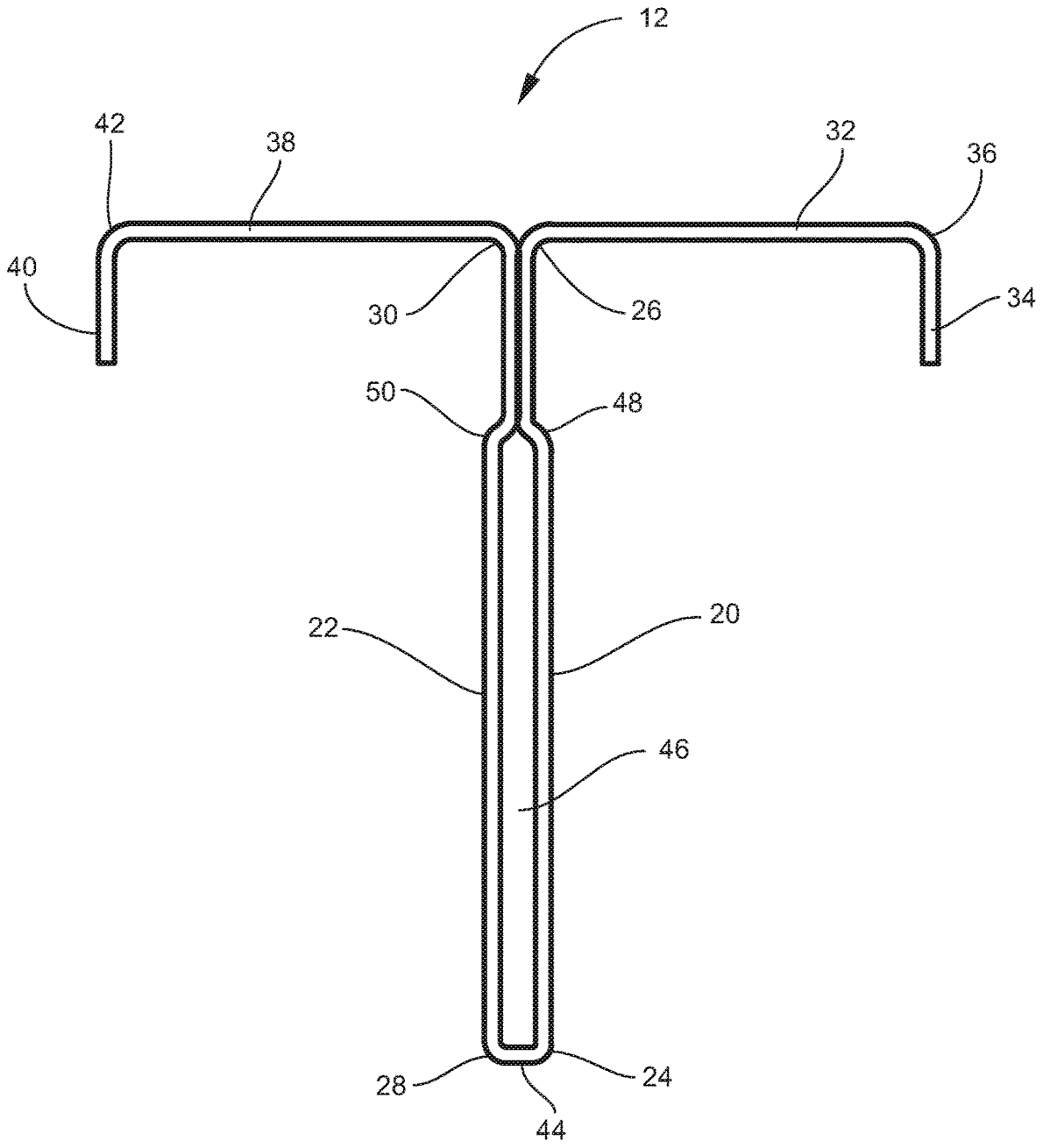
FIG. 4 is a side view of a chord of the present invention.

As shown in FIGS. 2 and 4, the upper chord 12 contains a first face 20 and a second face 22. The first face 20 contains a bottom longitudinal corner 24 and a top longitudinal corner 26, and the second face 22 contains a bottom longitudinal corner 28 and a top longitudinal corner 30. A first flange 32 extends laterally outwardly from the first face 20 of the upper chord 12 at the top longitudinal corner 26. A longitudinal extending lip 34 extends downwardly from an outer edge 36 of the upper chord 12. A second flange 38 extends laterally outwardly from the second face 22 of the upper chord 12 at the top longitudinal corner 30. A longitudinal expending lip 40 extends downwardly from an outer edge 42 of the upper chord 12. A lower connection member 44 connects the bottom longitudinal corner 24 of the first face 20 to the bottom longitudinal corner 28 of the second face 22 forming a first end of the cavity 46.

The lower portion of the internal surface of the first face 20 and the lower portion of the internal surface of the second face 22 are spaced apart and form a cavity 46 therein. A first neck portion 48 on the first face 20 angles the first face 20 towards the longitudinal axis of the upper chord 12 and a second neck portion 50 on the second face 22 angles the second face 22 towards the longitudinal axis of the upper chord 12, wherein the internal surface of the first face 20 and the internal surface of the second face 22 are adjacent each other, forming a second end of the cavity 46.

Figure 3:
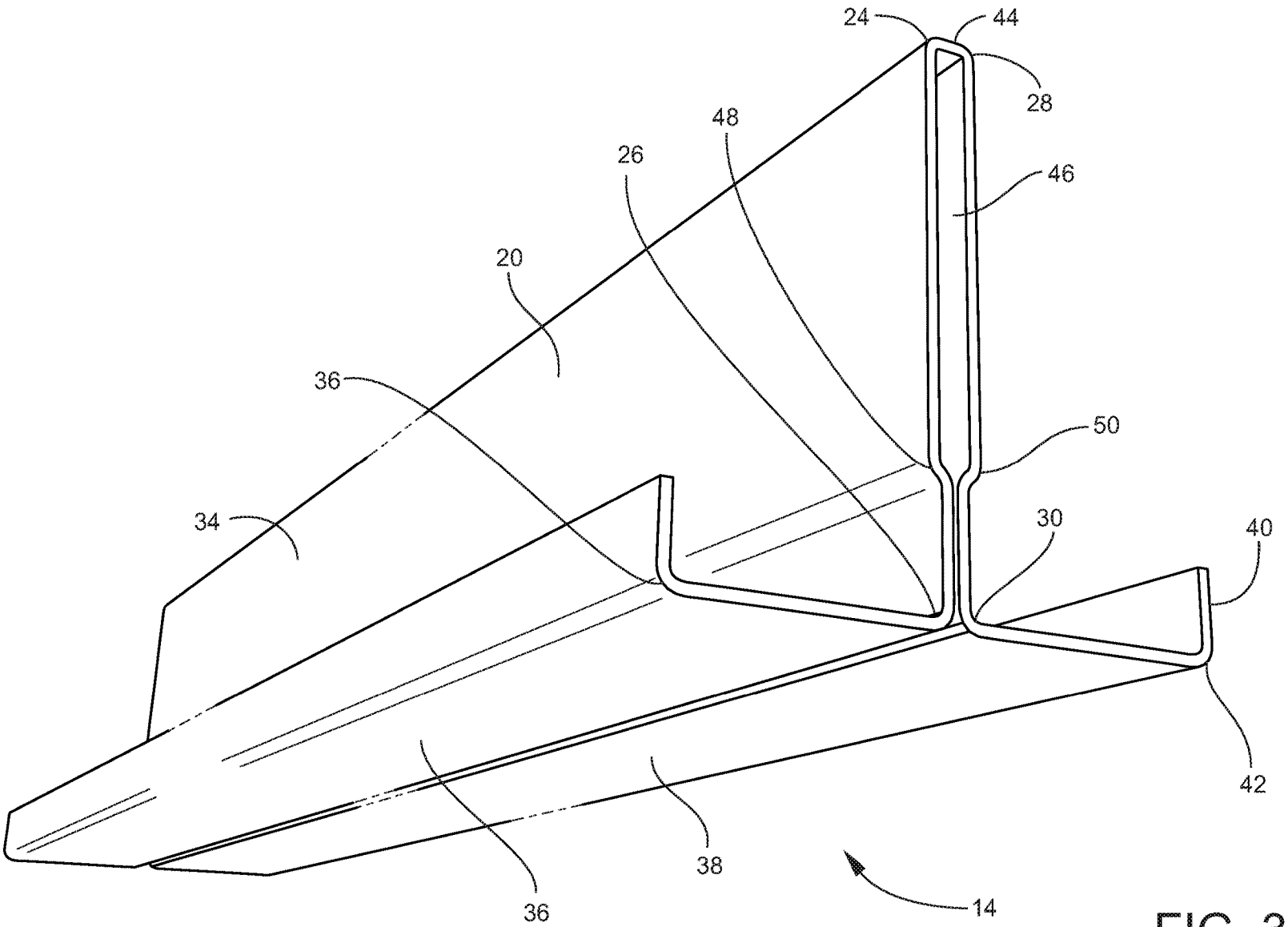
FIG. 3 is a perspective view of the lower chord of the present invention.

As shown in FIG. 3, the lower chord 14 contains a first face 20 and a second face 22. The first face 20 contains a bottom longitudinal corner 24 and a top longitudinal corner 26, and the second face 22 contains a bottom longitudinal corner 28 and a top longitudinal corner 30. A first flange 32 extends laterally outwardly from the first face 20 of the lower chord 14 at the top longitudinal corner 26. A longitudinal expending lip 34 extends downwardly from an outer edge 36 of the lower chord 14. A second flange 38 extends laterally outwardly from the second face 22 of the lower chord 14 at the top longitudinal corner 30. A longitudinal expending lip 40 extends downwardly from an outer edge 42 of the lower chord 14. A lower connection member 44 connects the bottom longitudinal corner 24 of the first face 20 to the bottom longitudinal corner 28 of the second face 22 forming a first end of the cavity 46.

The lower portion of the internal surface of the first face 20 and the lower portion of the internal surface of the second face 22 are spaced apart and form a cavity 46 therein. A first neck portion 48 on the first face 20 angles the first face 20 towards the longitudinal axis of the lower chord 14 and a second neck portion 50 on the second face 22 angles the second face 22 towards the longitudinal axis of the lower chord 14, wherein the internal surface of the first face 20 and the internal surface of the second face 22 are adjacent each other, forming a second end of the cavity 46.

The bottom longitudinal corner 24 is preferably at a generally right angle to the first face 20 and first flange 32. The top longitudinal corner 30 is preferably at a generally right angle to the second face 22 and the second flange 38. The bottom longitudinal corner 24 is preferably at a generally right angle to the first face 20 and lower connection member 44, and likewise, the bottom longitudinal corner 28 is preferably at a generally right angle to the second face 22 and lower connection member 44. The outer edge is preferably at a generally right angle to the first flange 32 and lip 34. The outer edge 42 is preferably at a generally right angle to the second flange 38 and lip 40.

As shown in FIG. 1, the upper chord 12 is positioned on the top side of the building truss 10 with the exterior side of the first flange 32 and second flange 38 facing upwards. The external surface of the lower connection member 44 is facing downwards. The lower chord 14 is positioned on the bottom side of the building truss 10 with the exterior side of the first flange 32 and second flange 38 facing downwards. The external surface of the lower connection member 44 is facing upwards.

Figure 5:
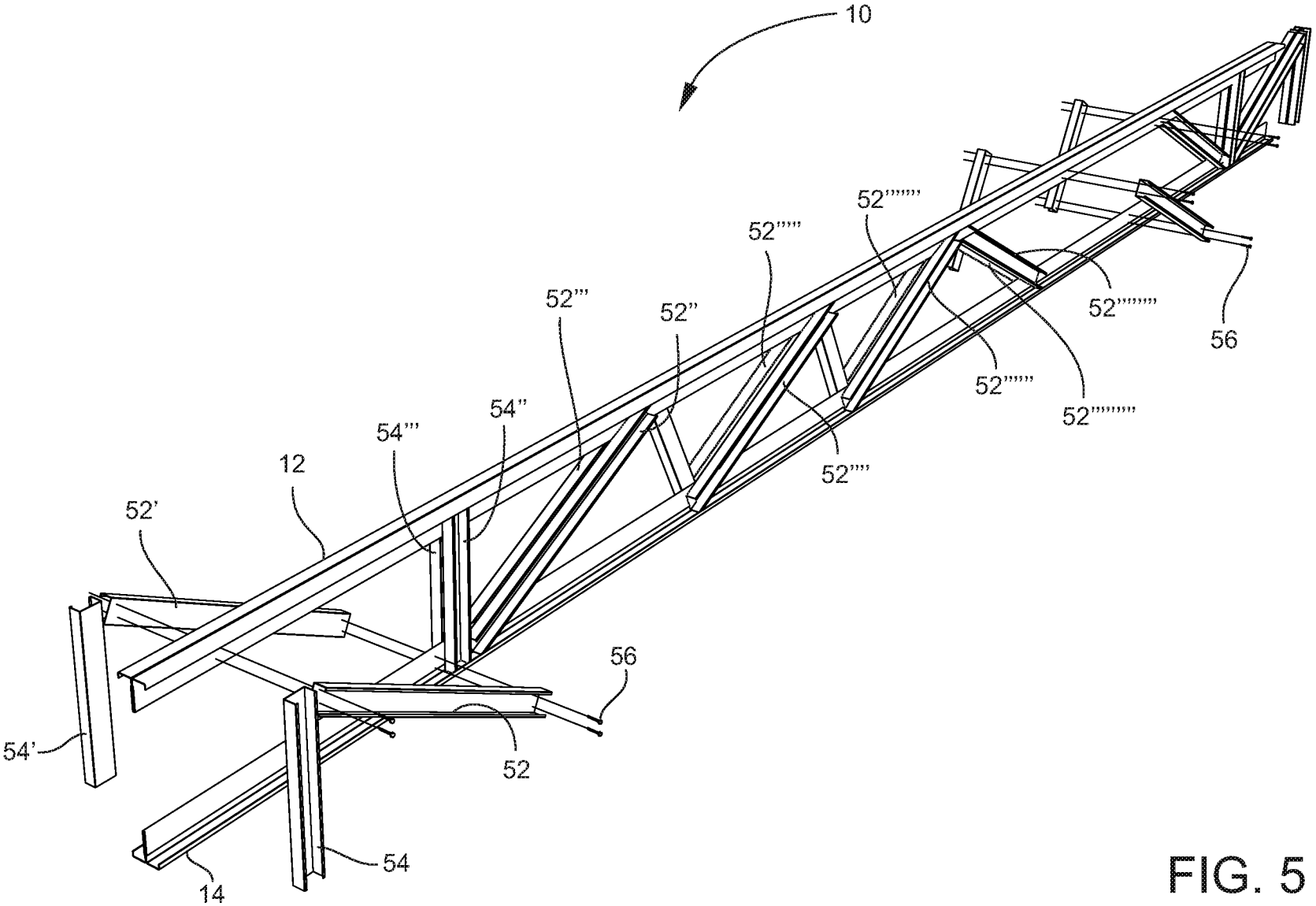
FIG. 5 is a perspective view of a truss of the present invention showing installation of diagonal and vertical webs attaching to the upper and lower chord.

The truss 10 includes a plurality of webs that extend between the upper chord 12 and the lower chord 14, as shown in FIG. 1. As shown in FIG. 5, the webs consist of a diagonal web 52 having a first end engaged to the upper chord 12 and a second end engaged to the lower chord 14. The vertical web 54 has a first end engaged to the upper chord 12 and a second end engaged to the lower chord 14. The webs (52, 54) are engaged to the upper chord 12 and lower chord 14 by a fastening device 56, such as a screw, nut and bolt, or other like fastening device. Bores may be contained within the first end and second end of the webs (52, 54) and the corresponding portion of the upper longitudinal bore 12 and lower longitudinal bore 14 for inserting a fastening device 56, such as a bolt, or alternatively the fastening device 56, such as a screw is drilled or inserted through the web (52, 54) and upper chord 12 or lower chord 14.

The diagonal web 52 and vertical web 54 are generally c-shaped. The webs (52, 54) contain a base that extends outward to two opposed side edges and two opposed end edges. A pair of opposed side walls extend upwardly from the side edges to an upper edge. When engaged to the upper longitudinal truss 12 or lower longitudinal truss 14, the opposed side walls face outwardly from the upper chord 12 and lower chord 14 and the back side of the base of the web (52, 54) is engaged to upper chord 12 and lower chord 14.

The first end of a vertical web 54 is engaged to the first face 20 of the upper chord 12 and the second end of the vertical web 54 is engaged to the first face 20 of the lower chord 14. A second vertical web 54' is engaged to the second face 22 of the upper chord 12 and the second end of the vertical web 54' is engaged to the second face 22 of the lower chord 14. Adjacent to the vertical webs 52 and 52', the first end of a diagonal web 52 is engaged to the first face 20 of the upper chord 12 and the second end of the diagonal web 52 is engaged to the first face 20 of the lower chord 14. A second diagonal web 52' is engaged to the second face 22 of the upper chord 12 and the second end of the diagonal web 52' is engaged to the second face 22 of the lower chord 14.

Another vertical web 54" is engaged to the upper chord 12 and lower chord 14 of the truss 10 and adjacent the diagonal web 52. A vertical web 54'" is engaged to the truss 10 adjacent the diagonal web 52'. Likewise, another diagonal web 52" is engaged to the upper chord 12 and lower chord 14 of the truss 10 and diagonal web 52'" is also engaged to the upper chord 12 and lower chord 14 of the truss 10. As shown in FIG. 5, diagonal web 52" and diagonal web 52'" face the opposite direction of diagonal web 52 and diagonal web 52'. In this embodiment, the first end of diagonal web 52" is engaged to the lower chord 14 and the second end is engaged to the upper chord 12. Likewise, the first end of diagonal web 52'" is engaged to the lower chord 14 and the second end is engaged to the upper chord 12. As illustrated in FIGS. 1 and 5, the diagonal webs 52"", 52"", 52"", and 52"" continue with this arrangement of the first end engaged to the lower chord 14 and the second end engaged to the upper chord 12. In the next set of diagonal webs 52"" and 52"", the first end is engaged to the upper chord 12 and the second end is engaged to the lower chord 14. The arrangement of the diagonal webs 52 can be in any form desired by the user or that is structurally beneficial to the truss 10.

Figure 6:
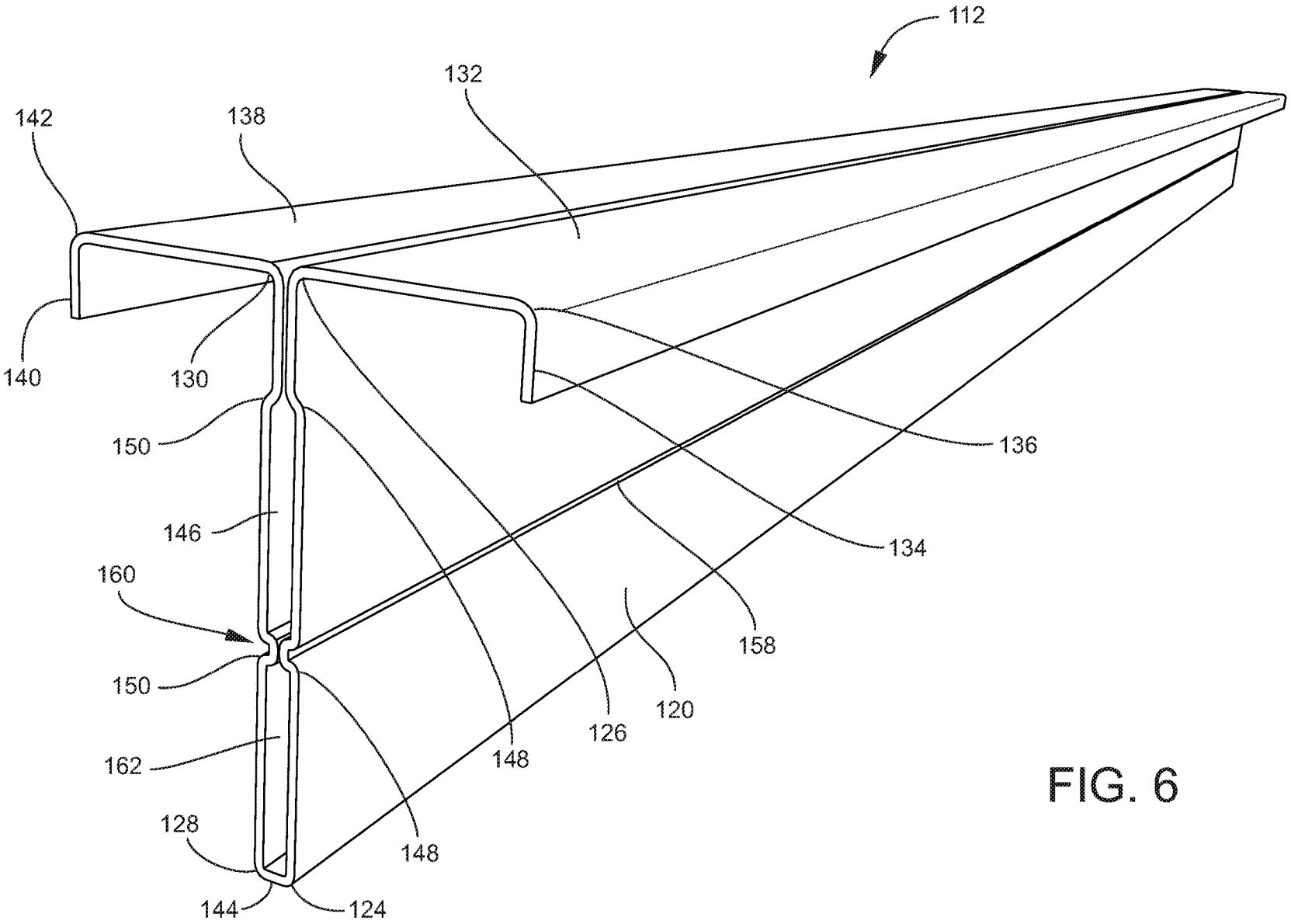
FIG. 6 is a perspective view of an alternative embodiment of an upper chord of the present invention.
Figure 8:
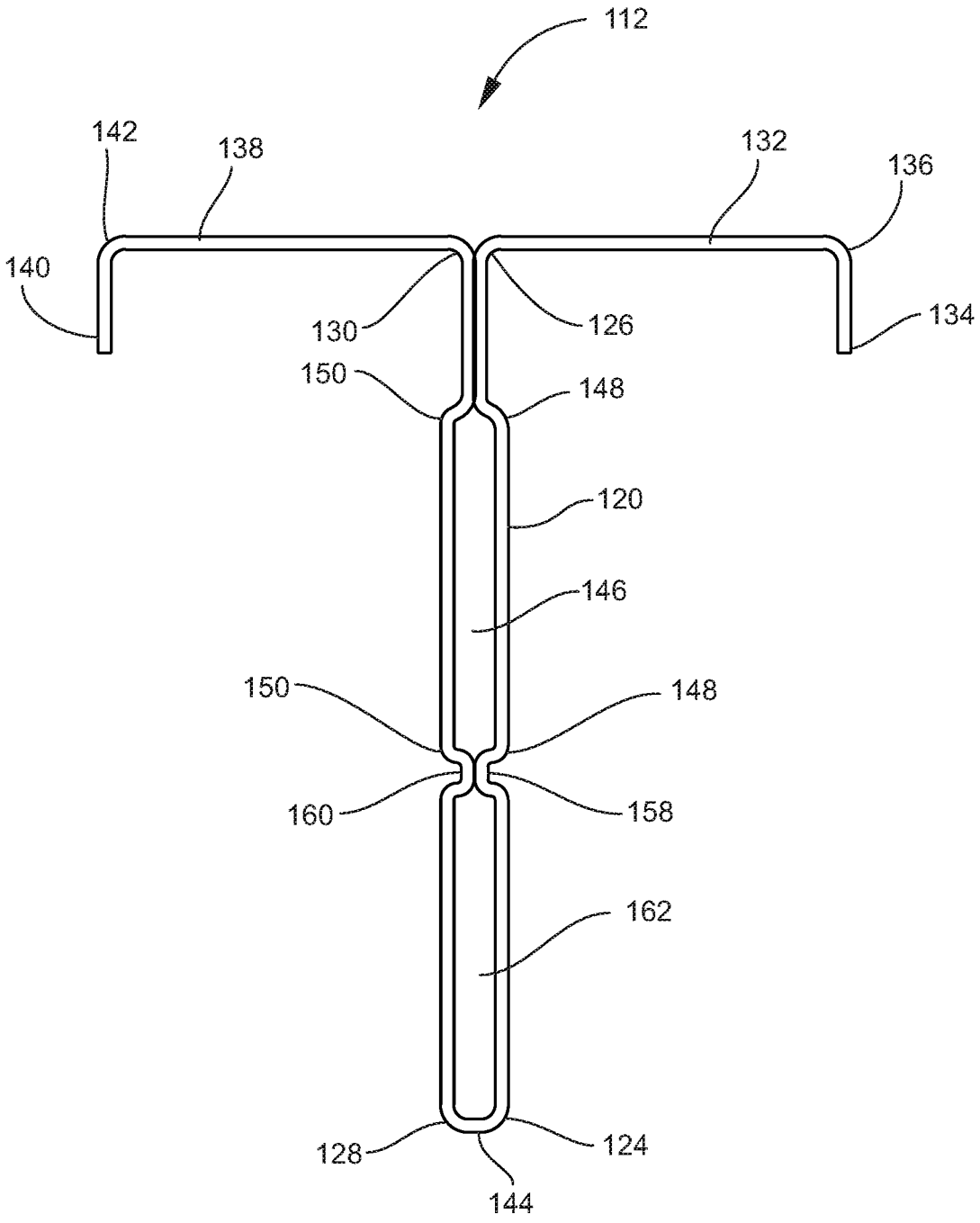
FIG. 8 is a side view of an alternative embodiment of a chord of the present invention.

In an alternative embodiment and as shown in FIGS. 6 and 8, an upper chord 112 contains a first face 120 and a second face 122. The first face 120 contains a bottom longitudinal corner 124 and a top longitudinal corner 126, and the second face 122 contains a bottom longitudinal corner 128 and a top longitudinal corner 130. A first flange 132 extends laterally outwardly from the first face 120 of the upper chord 112 at the top longitudinal corner 126. A longitudinal expending lip 134 extends downwardly from an outer edge 136 of the upper chord 112. A second flange 138 extends laterally outwardly from the second face 122 of the upper chord 112 at the top longitudinal corner 130. A longitudinal extending lip 140 extends downwardly from an outer edge 142 of the upper chord 112. A first channel 158 extends along the length of the first face 120, and a second channel 160 extends along the length of the second face 122. The external side of the first channel 158 and the second channel 160 is a concave portion that extends along the length of the first face 120 and second face 122, respectively.

The lower portion of the internal surface of the first face 120 and the lower portion of the internal surface of the second face 122 are spaced apart and form a first cavity 146 and a second cavity 162 therein. A first neck portion 148 on the first face 120 angles the first face 120 towards the longitudinal axis of the upper chord 112 and a second neck portion 150 on the second face 122 angles the second face 122 towards the longitudinal axis of the upper chord 112, wherein the internal surface of the first face 120 and the internal surface of the second face 122 are adjacent each other, forming a second end of the cavity 146. The internal side of the first channel 158 extends inwardly to the longitudinal axis and connects with the internal side of the second channel 160 that is also extending inwardly to the longitudinal axis and forming the first end of the first cavity 146 and a first end of the second cavity 162. A lower connection member 144 connects the bottom longitudinal corner 124 of the first face 120 to the bottom longitudinal corner 128 of the second face 122 forming a first end of the second end of the second cavity 162.

Figure 7:
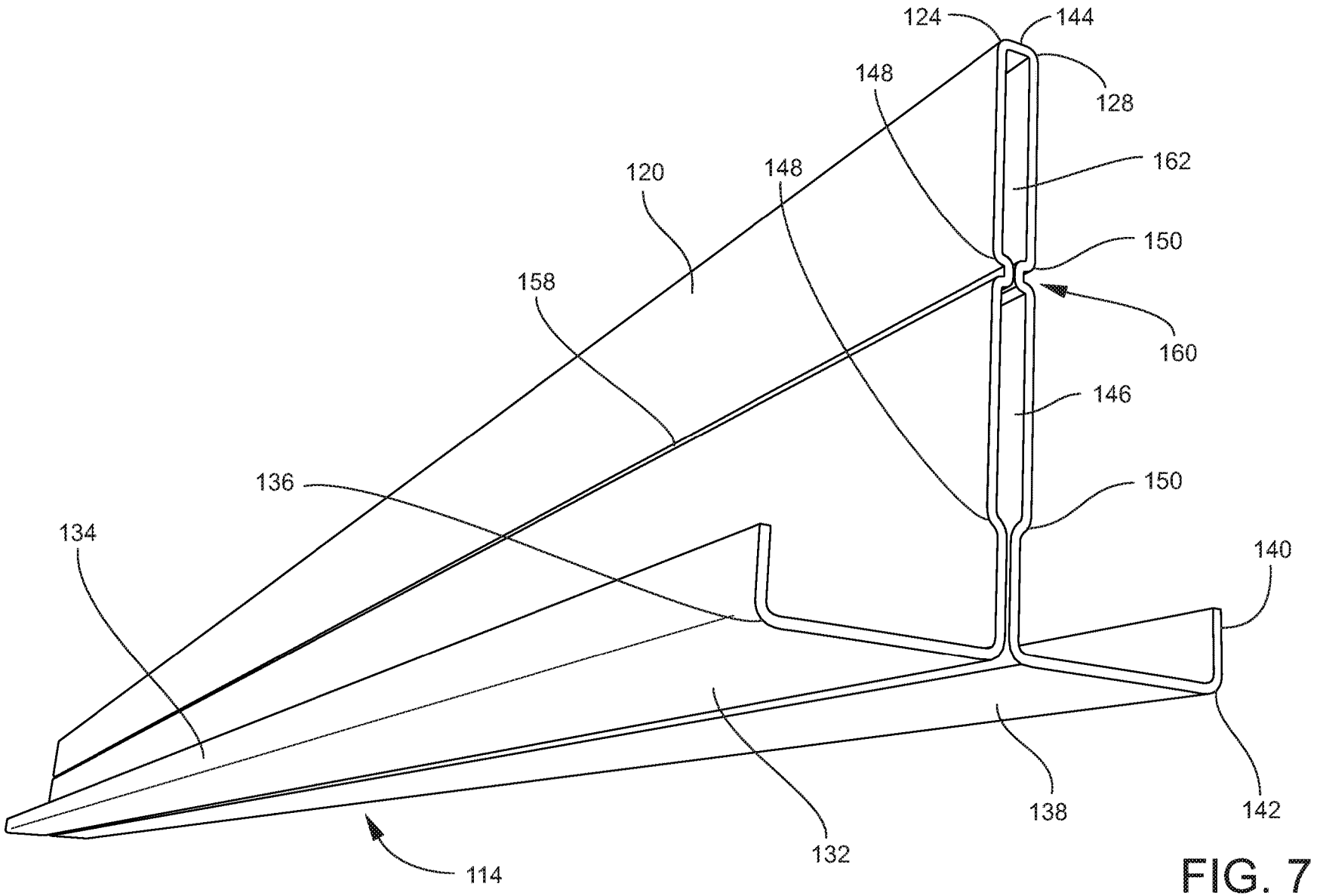
FIG. 7 is a perspective view of an alternative embodiment of a lower chord of the present invention.

As shown in FIG. 7, the lower chord 114 contains a first face 120 and second face 122. The first face 120 contains a bottom longitudinal corner 124 and a top longitudinal corner 126, and the second face 122 contains a bottom longitudinal corner 128 and a top longitudinal corner 130. A first flange 132 extends laterally outwardly from the first face 120 of the lower chord 114 at the top longitudinal corner 126. A longitudinal expending lip 134 extends downwardly from an outer edge 136 of the lower chord 114. A second flange 138 extends laterally outwardly from the second face 122 of the lower chord 114 at the top longitudinal corner 130. A longitudinal expending lip 140 extends downwardly from an outer edge 142 of the lower chord 114.

The lower portion of the internal surface of the first face 120 and the lower portion of the internal surface of the second face 122 are spaced apart and form a cavity 146 therein. A first neck portion 148 on the first face 120 angles the first face 120 towards the longitudinal axis of the lower chord 114 and a second neck portion 150 on the second face 122 angles the second face 122 towards the longitudinal axis of the lower chord 114, wherein the internal surface of the first face 120 and the internal surface of the second face 122 are adjacent each other, forming a second end of the cavity 146. The internal side of the first channel 158 extends inward to the longitudinal axis and connects with the internal side of the second channel 160 that is also extending inward to the longitudinal axis and forming the first end of the first cavity 146 and the first end of the second cavity 162. A lower connection member 144 connects the bottom longitudinal corner 124 of the first face 120 to the bottom longitudinal corner 128 of the second face 122, forming a first end of the second end of the second cavity 162.

The bottom longitudinal corner 124 is preferably at a generally right angle to the first face 120 and first flange 132. The top longitudinal corner 130 is preferably at a generally right angle to the second face 122 and second flange 138. The bottom longitudinal corner 124 is preferably at a generally right angle to the first face 120 and lower connection member 144, and likewise, the bottom longitudinal corner 128 is preferably at a generally right angle to the second face 122 and lower connection member 144. The outer edge is preferably at a generally right angle to the first flange 132 and lip 134. The outer edge 142 is preferably at a generally right angle to the second flange 138 and lip 140.

Figure 9:
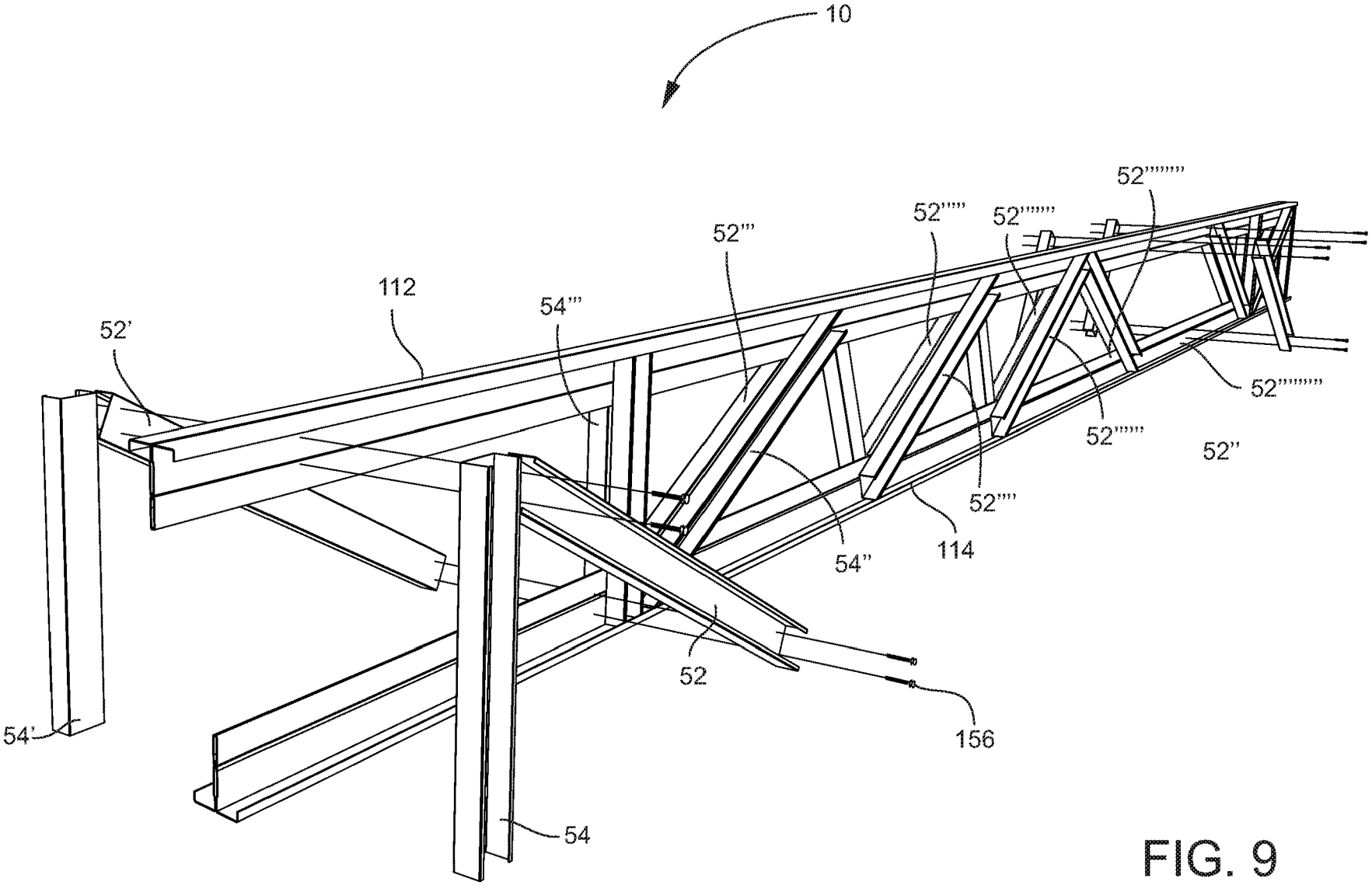
FIG. 9 is a perspective view of an alternative embodiment of the truss of the present invention showing installation of the diagonal and vertical webs attaching to the upper and lower chord.

As shown in FIG. 9, the first end of a vertical web 154 is engaged to the first face 120 of the upper chord 112 and the second end of the vertical web 154 is engaged to the first face 120 of the lower chord 114. A second vertical web 154' is engaged to the second face 122 of the upper chord 112 and the second end of the vertical web 154' is engaged to the second face 122 of the lower chord 114. Adjacent to the vertical webs 152 and 152', the first end of a diagonal web 152 is engaged to the first face 120 of the upper chord 112 and the second end of the diagonal web 152 is engaged to the first face 120 of the lower chord 114. A second diagonal web 152' is engaged to the second face 122 of the upper chord 112 and the second end of the diagonal web 152' is engaged to the second face 122 of the lower chord 114.

Another vertical web 154" is engaged to the upper chord 112 and lower chord 114 of the truss 110 and adjacent the diagonal web 152. A vertical web 154'" is engaged to the truss 110 adjacent the diagonal web 152'. Likewise, another diagonal web 152" is engaged to the upper chord 112 and lower chord 114 of the truss 110 and diagonal web 152'" is also engaged to the upper chord 112 and lower chord 114 of the truss 110. The diagonal web 152" and diagonal web 152'" face the opposite direction of diagonal web 152 and diagonal web 152'. In this embodiment, the first end of diagonal web 152" is engaged to the lower chord 114 and the second end is engaged to the upper chord 112. Likewise, the first end of diagonal web 152'" is engaged to the lower chord 114 and the second end is engaged to the upper chord 112. The diagonal webs 152"", 152'"", 152""", and 152'""" continue with this arrangement of the first end is engaged to the lower chord 114 and the second end is engaged to the upper chord 112. The next set of diagonal webs 152"""" and 152'"""" the first end is engaged to the upper chord 112 and the second end is engaged to the lower chord 114. The arrangement of the diagonal webs can be in any form desired by the user or that is structurally beneficial to the truss 110.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A chord, comprising:

a first face having a bottom longitudinal corner, a top longitudinal corner, and a first inner surface;

a second face having a bottom longitudinal corner, a top longitudinal corner, and a second inner surface, a portion of the first face and the second face are spaced apart and form a symmetrical cavity between the first inner surface of the first face and the second inner surface of the second face a lower connection member disposed between the bottom longitudinal corner of the first face and the bottom longitudinal corner of the second face;

a first flange extends laterally outwardly from the top longitudinal corner of the first face to a first outer edge;

a second flange extends laterally outwardly from the top longitudinal corner of the second face to a second outer edge;

a first longitudinally extending lip extends downwardly from the first outer edge; and a second longitudinally extending lip extends downwardly from the second outer edge.

2. The chord according to claim 1, further comprising a first neck portion on the first face that is angled towards a longitudinal axis of the chord and a second neck portion on the second face that is angled towards the longitudinal axis of the chord.

3. The chord according to claim 1, further comprising an internal surface on the first face and an internal surface of the second face are engaged to each other and form an end to the cavity.

4. A chord, comprising:

a first face having a bottom longitudinal corner, a top longitudinal corner, and a first inner surface;

a second face having a bottom longitudinal corner, a top longitudinal corner, and a second inner surface; the first face and second face are spaced apart and form a first cavity and a second cavity between the first inner surface of the first face and the second inner surface of the second face;

a lower connection member disposed between the bottom longitudinal corner of the first face and the bottom longitudinal corner of the second face; and a first channel extends along the length of the first face and a second channel extends along the length of the second face, the first channel includes a first internal side and the second channel includes a second internal side, the first internal side of the first channel extends inwardly to the longitudinal axis of the chord and the second internal side of the second channel extends inwardly to the longitudinal axis of the chord where it connects with the first internal side of the first channel forming a first end of the first cavity and a first end of the second cavity where the first cavity is positioned above the location where the first internal side connects with the second internal side and the second cavity is positioned below the location where the first internal side connects with the second internal side.

5. The chord according to claim 4, further comprising a first flange that extends laterally outwardly from the first face.

6. The chord according to claim 5, further comprising a lip extending downwardly from the first flange.

7. The chord according to claim 4, further comprising a second flange that extends laterally outwardly from the second face.

8. The chord according to claim 7, further comprising a lip extending downwardly from the second flange.

9. A building truss comprising:

an upper chord comprising, a first face having a bottom longitudinal corner, a top longitudinal corner, and a first inner surface;

a second face having a bottom longitudinal corner, a top longitudinal corner, and a second inner surface, a portion of the first face and second face are spaced apart and form a cavity between the first inner surface of the first face and the second inner surface of the second face;

a lower connection member disposed between the bottom longitudinal corner of the first face and the bottom longitudinal corner of the second face;

a first flange extends laterally outwardly from the top longitudinal corner of the first face to a first outer edge;

a second flange extends laterally outwardly from the top longitudinal corner of the second face to a second outer edge;

a first longitudinally extending lip extends downwardly from the first outer edge; and a second longitudinally extending lip extends downwardly from the second outer edge;

a lower chord comprising;

a first face having a bottom longitudinal corner, a top longitudinal corner, and a first inner surface;

a second face having a bottom longitudinal corner, a top longitudinal corner, and a second inner surface, a portion of the first face and second face are spaced apart and form a cavity between the first inner surface of the first face and the second inner surface of the second face;

a lower connection member disposed between the bottom longitudinal corner of the first face and the bottom longitudinal corner of the second face;

a first flange extends laterally outwardly from the top longitudinal corner of the first face to a first outer edge;

a second flange extends laterally outwardly from the top longitudinal corner of the second face to a second outer edge;

a first longitudinally extending lip extends downwardly from the first outer edge; and a second longitudinally extending lip extends downwardly from the second outer edge;

a plurality of webs are positioned between and engaged to the upper chord and the lower chord.

10. The building truss according to claim 9, further comprising a plurality of diagonal webs positioned between and engaged to the upper chord and the lower chord.

11. The building truss according to claim 9, further comprising a plurality of vertical webs positioned between and engaged to the upper chord and the lower chord.

12. The building truss according to claim 9, further comprising a plurality of vertical webs and a plurality of diagonal webs, wherein the diagonal webs and the vertical webs alternate along the length of the building truss.

13. The building truss according to claim 9, wherein the building truss is composed of metal.

* * * * *